United States Patent [19]

Shalinsky et al.

[11] Patent Number: 4,738,487

[45] Date of Patent: Apr. 19, 1988

[54] TILTING SEAT

[75] Inventors: Bernard Shalinsky, Montreal; Christopher J. Scrase, Dorval; Raymond Mitchell, Montreal, all of Canada

[73] Assignee: Ergoform Inc., Que, Canada

[21] Appl. No.: 853,673

[22] Filed: Apr. 18, 1986

Related U.S. Application Data

[63] Continuation-in-part of Ser. No. 613,039, May 22, 1984, abandoned.

[51] Int. Cl.[4] ..... A61G 15/00

[52] U.S. Cl. ..... 297/338; 297/313; 297/DIG. 4; 248/129; 248/629

[58] Field of Search ..... 297/DIG. 4, 338, 337, 297/326, 343, 195, 313, 388; 248/129, 629, 420, 395

[56] References Cited

U.S. PATENT DOCUMENTS

| | | | |
|---|---|---|---|
| 2,823,924 | 2/1958 | Carmichael | 248/129 X |
| 3,511,533 | 5/1970 | Drabert | 297/337 |
| 3,625,563 | 12/1971 | Dickinson | 297/338 X |
| 3,679,260 | 7/1972 | Morse-Brown | 297/338 |
| 3,863,978 | 2/1975 | Gillings | 297/195 X |
| 4,109,961 | 8/1978 | Opsvik | 297/338 |
| 4,510,631 | 4/1985 | Grady | 297/DIG. 4 X |

FOREIGN PATENT DOCUMENTS

| | | | |
|---|---|---|---|
| 555850 | 7/1932 | Fed. Rep. of Germany | 297/338 |
| 2642112 | 3/1978 | Fed. Rep. of Germany | 297/313 |

*Primary Examiner*—Kenneth K. Dorner
*Assistant Examiner*—Laurie K. Cranmer
*Attorney, Agent, or Firm*—Samuel Meerkreebs

[57] ABSTRACT

A tilting seat having a base for supporting the seat on the floor and a stem extending upwardly from the base, either integrally or separably from the base, the seat being arranged such that it tilts about a tilting axis passing through the base such that a user can tilt the seat forward when in a working position. The base may be a turntable.

9 Claims, 5 Drawing Sheets

TILTING SEAT

CROSS-REFERENCE TO RELATED APPLICATION

This application is a continuation-in-part of application Ser. No. 613,039, filed May 22, 1984.

BACKGROUND OF THE INVENTION

1. Field of the Invention

The present invention relates to seats, and particularly to a tilting seat.

2. Description of the Prior Art

It is estimated that between 65 and 75% of days lost from work is due to back ailments. More and more, particularly with the development of computers, the worker is required to spend a greater amount of time sitting at a work station. On the other hand, most conventional chairs or seating arrangements presently utilized in the workplace require the user to hunch forward in order to work at a desk or table. By hunching forward, the stress on the lumbar region is increased by 300%, resulting in premature disintegration of the lower discs and vertebral arthritic degeneration.

In recent years, a myriad of "ergonomically" designed chairs have been developed, all of which use a backward inclined seat. Although these chairs have proved to be more "comfortable" in the reclined position, the user is still obliged to hunch forward in order to work at a desk or table. By hunching forward, the stress on the lower spine (lumbar region) is increased some 300%; the result being a premature disintegration of the lower discs and vertebral arthritic degeneration.

Recent research has brought about a greater comprehension of the function of the lumbar spine and brings into question the basic traditional seated work position. Based on the sound physiological evidence as provided by internationally recognized experts such as Doctors Keegan, Nachemson, and Grandjean, the ideal seated work posture should maintain a minimum curve in the lower spine (lordosis). This position allows the efficient support of the body weight, with the least amount of work and stress. In most cases, a person using a backward inclined seat, eradicates the lordosis by leaning forward to work. The forward inclined seat compensates for this necessary movement towards the work surface by allowing the person to tilt his whole body forward, thus eliminating the rounding of the back and the subsequent loss of the lordotic curve. The forward incline makes it possible for a person to maintain this critical lordosis of the lumbar spine while performing many different tasks.

Recent research has brought about a greater understanding of the structure and function of the lumbar spine and brings into question the basic traditional seating and the position of the user. According to physiological evidence, the ideal seated work posture should maintain a minimum lordotic curve in the lower spine. This position allows the efficient support of the body weight with the least amount of stress.

SUMMARY OF THE INVENTION

It is an aim of the present invention to provide a seat which would be comfortable in a rest position, that is, in a normal sitting position, and which would tilt forward with the user as the user advances himself to the work table, thereby generally maintaining an upright back position with a slight lordotic curve of the lumbar region.

It is also an aim of the present invention to provide a seat which will be inclined forwardly when the seat is advanced or tilted towards a work position and allows the user to tilt his or her body forward, thus eliminating the hunching of the back and the subsequent loss of lordosis in the lumbar spine.

A construction in accordance with the present invention comprises a seat having a base, a stem pivotally mounted on the base and tiltable relative to the base about a pivot axis at the base, a buttocks support mounted on the front of the stem, the stem extending rearwardly at an acute angle from a vertical plane containing the pivot axis and adapted to pivot from a rest position to a forward position where the stem is substantially near rearward of the vertical plane, the center of the buttocks support being substantially near the vertical plane in the rest position and forward of the vertical plane in the forward position, and means on the base limiting the pivoting arc of travel of the stem between the rest position and the forward position.

In a more specific construction of the present invention, the buttocks support is mounted to the front of the stem for limited pivotal movement relative to the stem about an axis parallel to the tilting axis.

It has been found that in a preferred embodiment the stem in its rest position would be supported at an angle of 21° from the vertical plane and at an angle of 9° from the vertical plane in its forward position such that the total pivotal arc of travel of the stem is 12°.

Thus, this construction allows the user to sit back on the seat or chair when not working over a work desk or table. However, when the user moves forward to work over the table, the buttocks support and the stem would merely follow the user and tilt forward allowing the user to maintain a proper erect position with the proper lordotic curve in the lumbar region. It is believed that this would allow the user to work in a much more comfortable position with considerably less stress on his back. The phenomenon is similar to the natural inclination, particularly with youngsters, to sit on the edge of their chair while working over a table. It has also been found, in studies, that it is important to maintain a relatively open or obtuse angle between the thighs and the upper body. With the embodiments described herein, this obtuse angle can be maintained between the thighs and the upper body even when the user is working over his work table due to the tilting and inclination of the buttocks support on the seat. Using an ordinary chair, even if moving the chair forward under the table while working over the table, the thighs assume a closed or acute angle with respect to the upper body when the user is hunched over the table.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
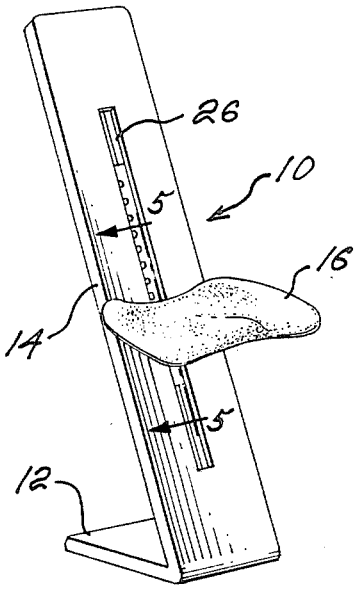
FIG. 1 a perspective view of one embodiment of the seat in accordance with the present invention.
Figure 2:
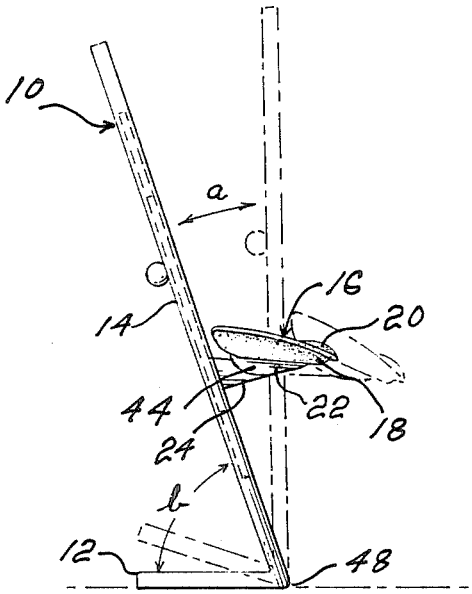
FIG. 2 is a side elevation of the seat shown in FIG. 1.

Referring now to the drawings, there is shown in FIGS. 1 and 2, a first embodiment of a seat 10 including a base 12, a stem 14, and a buttocks support 16.

The base 12 and stem 14 in this embodiment are integral, and as shown in FIG. 2, the base 12 describes an acute angle with the stem 14 extending over the base 12 at an angle of 71°. The buttocks support 16 is made of molded plastics material and may have a shell 18 and a soft interior 20. The buttocks support 16 is pivotally mounted at 22 on a bracket 24 which can be adjustably located along the longitudinal axis of the stem 14.

Figure 5:
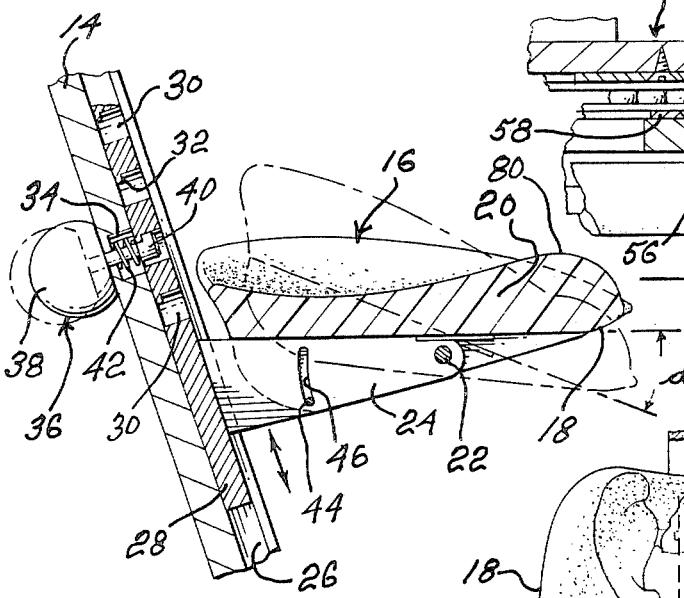
FIG. 5 is a fragmentary enlarged cross-section taken along line 5—5 in FIG. 1.

The stem 14 is in the form of an elongated member having a track 26 in the form of an elongated slot having a T-shaped cross-section. As shown in FIG. 5, the bracket 24 includes a carriage 28 sliding in the track 26. The carriage 28 is provided with a series of spaced-apart apertures 30 with each aperture having a radial flange 32. The back of the stem 14 is provided with a bore 34.

A locking pin 36, including a rounded knob 38 and an L-shaped pin 40, passes through the bore 34. The locking pin 36 also includes a spring 42 in the recessed part of the bore 34. The L-shaped pin 40 is adapted to engage in apertures 30 of the carriage 28 to lock the carriage in a selected position.

When it is required to release the carriage 28 from a given position, the carriage must be moved upwardly slightly to disengage the L-shaped pin 40 from the flange 32. The pin 40 is then retracted against the spring 42 into the recessed portion 34, and the carriage 28 is then free to move to a new adusted vertical position. The spring 42 will be effective to move the locking pin 40 to a new aperture 30 on the carriage 28 when such aperture is aligned therewith.

As also seen in FIG. 5, the seat 16 is pivotally mounted on the pivot shaft 22 in the bracket 24, and the pivoting movement of the seat is restricted by a limit pin 44 which is fixed to the seat 16 and travels in an arcuate slot 46.

The stem 14 merges with the base 12 forming an acute angle with reference to the embodiment in FIGS. 1 and 2, and the angled surface 48 formed at the forward part of the base 12 is rounded, allowing the seat to be pivoted or tilted along the rounded surface 48 which defines a tilting axis of the seat 10.

Figure 8:
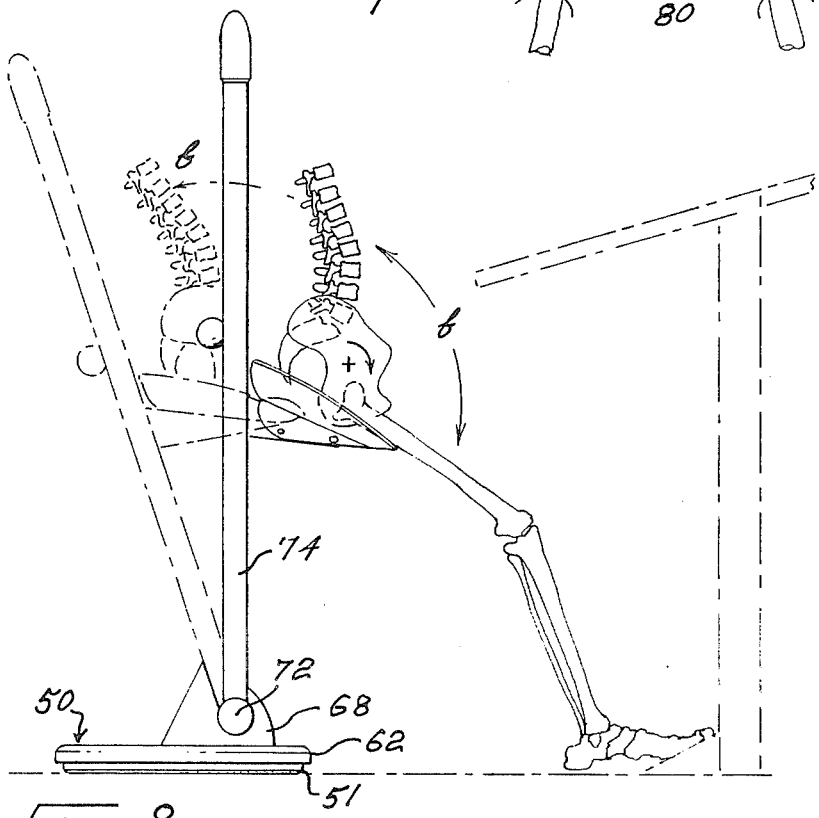
FIG. 8 is a schematic view showing the different positions of the seat.
Figure 9:
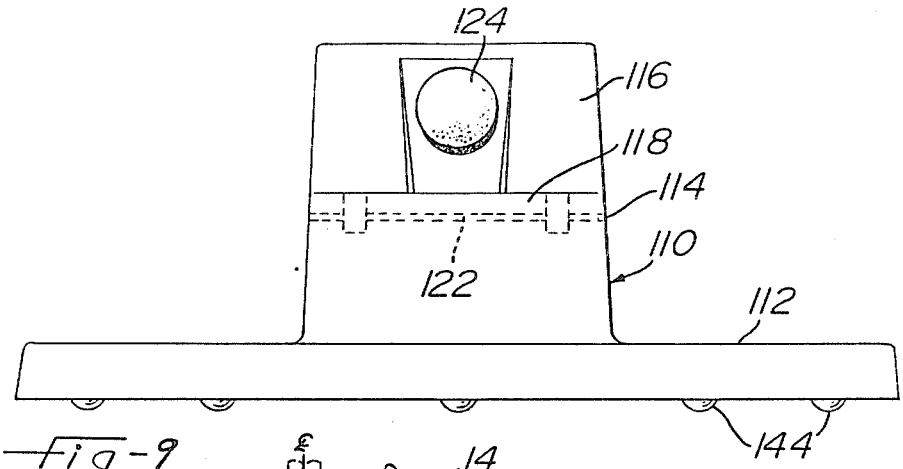
FIG. 9 is a front elevation of the base in accordance with an embodiment of the present invention.

As shown in FIGS. 1 and 2, the seat 10 is illustrated in a rest position. A user may sit on the seat in this position and be comfortably erect. If the user wishes to move forwardly to a work position within the arc between the position shown in full lines and that shown in dotted lines in FIG. 2, he need merely move himself forward (i.e., over a table), and the seat 10 will tilt forward with him. In the case of the embodiment shown in FIGS. 1 and 2, the seat will tilt about the axis defined by the surface 48, moving the center of gravity of the user from a position over or behind the vertical plane containing the axis of tilting to a position shown in dotted lines in FIG. 2 where the buttocks support 16 is well ahead of the vertical plane so defined. The user's forward movement also brings the center of gravity thereof beyond the vertical plane including the tilting axis, and the natural inclination to maintain an open obtuse angle f of the thighs to the upper body will cause the buttocks support 16 to pivot about the shaft 22 through a possible angle d of 45°. The angle f may vary from 130° in the rest position to 105° in the forward position. Thus, as seen in FIG. 8, when the seat is tilted forwardly, the lordotic curve in the lumbar region of the spine is maintained.

The tilting of the seat will normally be through an arc a in the drawings which may be in the area of 20°, although this arc may vary 5° either way.

It is also seen that if the user were to lean back from the table, the seat 10 will, because of its stable position, tilt back to a rest position as shown in FIGS. 1 and 2 in full lines.

Figure 4:
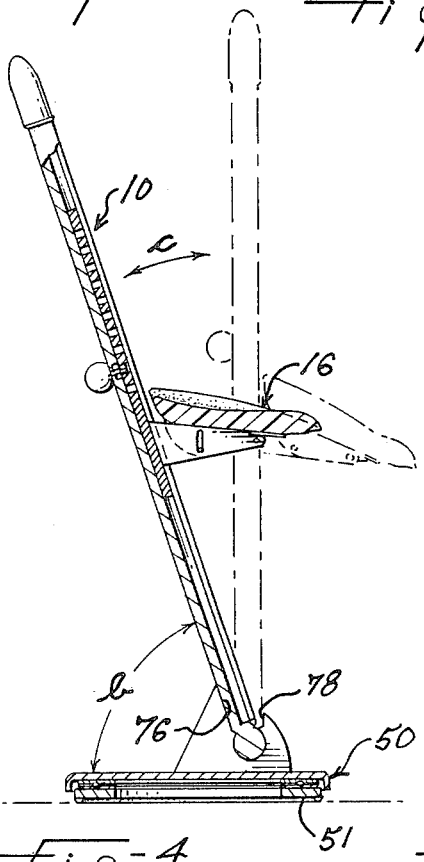
FIG. 4 is a vertical cross-section taken along line 4—4 in FIG. 3.
Figure 3:
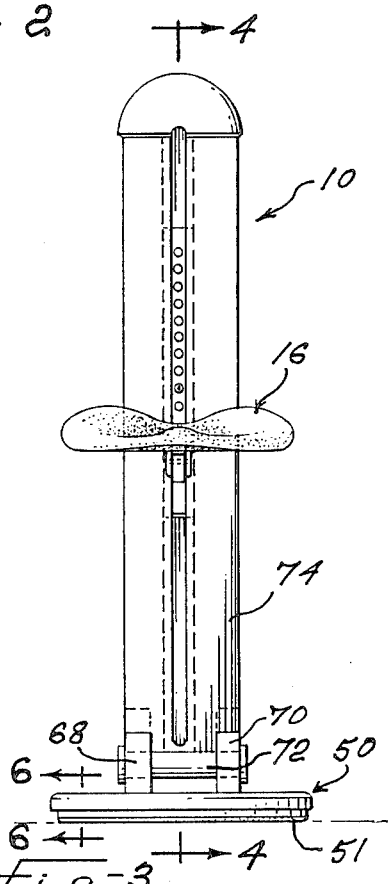
FIG. 3 is a front elevation of a seat showing another embodiment of the present invention.
Figure 6:
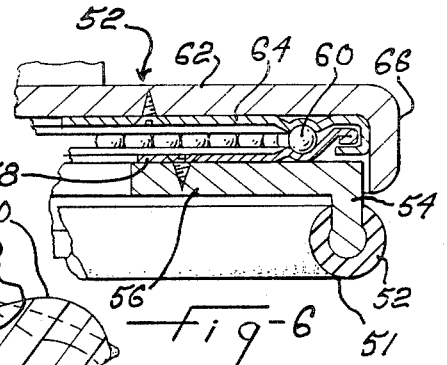
FIG. 6 is an enlarged fragmentary cross-section taken along line 6—6 of FIG. 3.

Another embodiment of the seat is shown in FIGS. 3, 4 and 6, in which the base 50 is in the form of a turntable, including a sub-base 51. The sub-base 51 may have a rubber or soft plastic molded covering 52 over the edge of a skirt 54 extending from an annulus 56 which is in a horizontal plane. A lower bearing race 58 is mounted to the annulus 56 and supports ball bearings 60 as shown in FIG. 6. An upper base portion 62 is provided which mounts an upper race 64 which cooperates with the lower race 58 and the ball bearings 60. The upper base portion 62 has an overhanging skirt 66. The upper base portion 62 mounts a pair of upstanding journals 68 and 70 which receive an arcuate lower member 72 of the stem 74. The journals have a rearward stop 76 and a forward stop 78 which limit the pivoting or tilting movement of the stem 74 relative to the base. The arc may be limited to 20°. The arc, identified by the letter c, is actually 12° with the forward position at 9° from the vertical plane through the pivot axis and the rest position at 21° from the vertical plane.

In the preferred embodiment, the stem 14 does not pass the vertical plane through the pivot axis of the stem, but rather its movement terminates in a forward position slightly behind the vertical plane. As can be seen, however, the buttocks support 16 in the rest position has its center position in the vertical plane or just slightly behind the vertical plane, while in the forward position, the buttocks support 16 is in front of the vertical plane. The user of the seat as described supports its full weight on the seat both in the rest position and the forward position, as shown in FIG. 8 of the drawings.

Thus, in the embodiment shown in FIGS. 3 and 4, the user has the advantage of the tilting seat previously described and may rotate the seat on the turntable.

Figure 7:
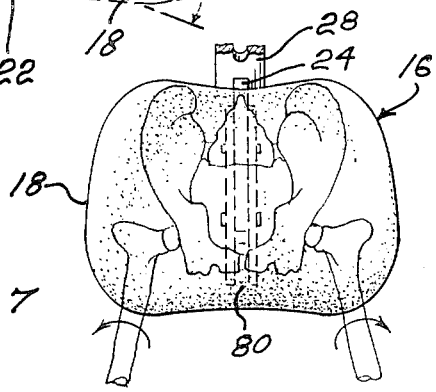
FIG. 7 is a fragmentary top plan view of a detail of the present invention.

FIGS. 7 and 8 represent the effect on the body and in particular as represented by a skelton diagram in these drawings. The buttocks support 16 is provided with an enlarged mound 80 forward and central of the support which influences the thigh bones to rotate outwardly in the direction of the arrows shown in FIG. 7, to provide a more natural and comfortable seating. FIG. 8 represents the position of the lumbar region of the spine in both the rest position and the tilting position of the seat 10.

Figure 10:
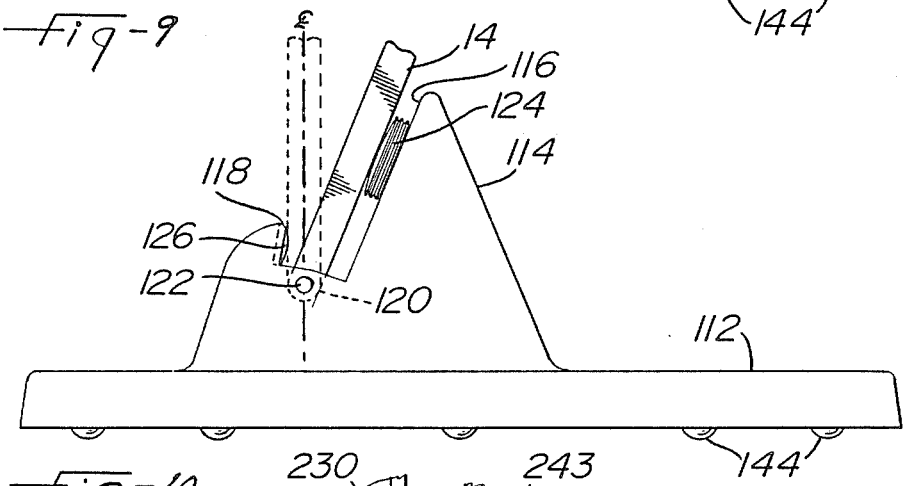
FIG. 10 is a side elevation of the base shown in FIG. 9.
Figure 14:
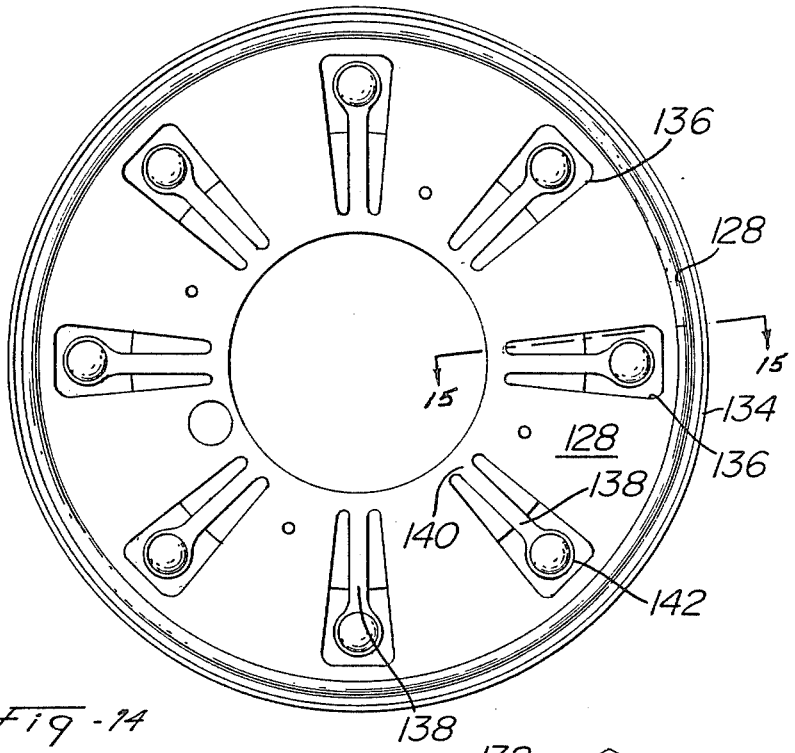
FIG. 14 is a bottom plan view of the base shown in FIG. 9.
Figure 15:
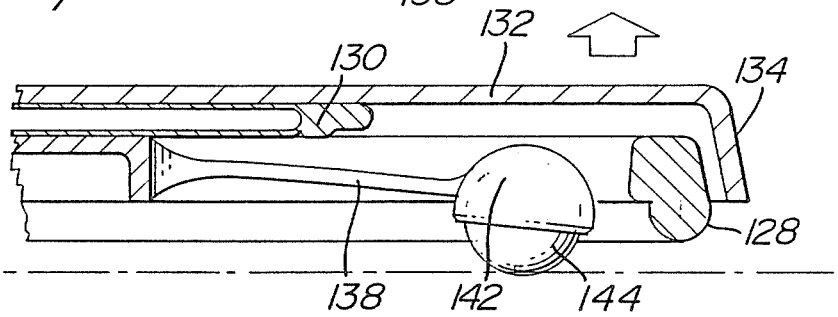
FIG. 15 is a cross-sectional view taken along line 15—15 of FIG. 14.
Figure 16:
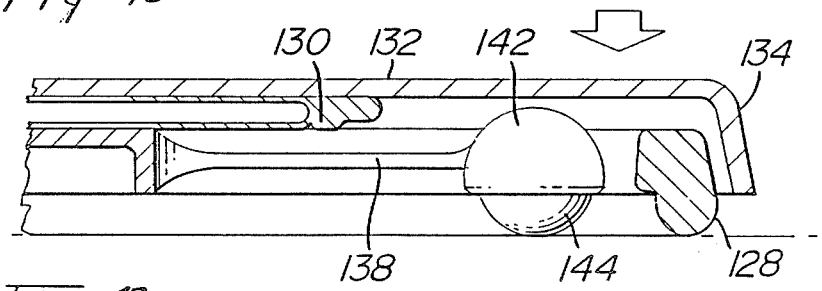
FIG. 16 is a cross-sectional view, similar to FIG. 15, but showing a detail thereof in a different operative position.

A different embodiment of the base is illustrated in FIGS. 9, 10, and 14 through 16. The base 110 includes a turntable portion 112 and an upstanding pedestal 114. As shown in FIG. 10, the pedestal 114 includes a slot defined by a pair of abutments 116 and 118 which limit the pivoting arc of travel of the stem 14. The stem 14 includes two ears 120 which are journaled on a pivot shaft 122. The abutment surface 116 is provided with a bellows type resilient device 124 while the abutment 118 is provided with a resilient stop 126. The base, as best shown in FIGS. 14 through 16, includes a sub-frame 128 mounted by means of a rubber or plastic suspension device 130 to the shell 132. The shell 132 includes a skirt 134 surrounding the periphery of the sub-frame 128. The sub-frame 128 is provided with a series of openings 136. A leg 138 is integrally molded at 140 to the sub-frame 128 or may be otherwise fixed thereto. The other end of the leg 138 includes a head 142 defining a spherical socket mounting a ball 144. The legs 138 are chosen of a material and size such that when there is no weight on the seat, the balls 144 are in contact with the ground or floor, but as soon as a weight is applied to the seat, the legs 138 will flex to allow the sub-frame 128 to rest on the floor and thereby prevent the rolling movement of the base.

Figure 12:
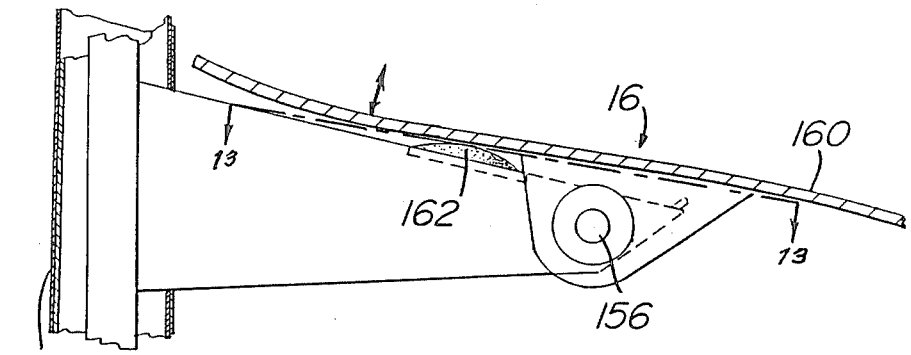
FIG. 12 is a fragmentary enlarged cross-section of a detail similar to that shown in FIG. 5 but of a different embodiment thereof.
Figure 13:
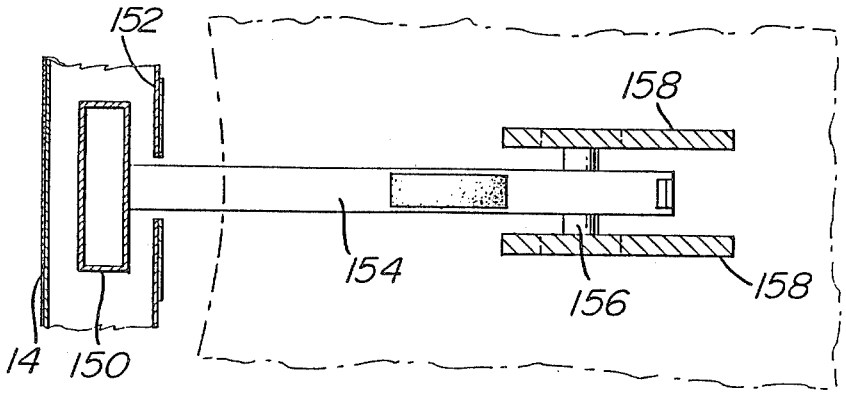
FIG. 13 is an enlarged fragmentary sectional view along line 13—13 of FIG. 12.

Referring now to FIGS. 12 and 13, there is shown a stem 14 having a carriage 150 sliding in the track 152. The carriage 150, which is similar to carriage 28, mounts a bracket 154. A pivot shaft 156 is fixed to the bracket 154, and a pair of downwardly extending ears 158 are pivotally mounted to the shaft 156. The ears 158 mount the shell 160 of the buttocks support. A small resilient pad 162 is provided on the upper surface of the bracket 154 to act as a stop for the rearward pivoting movement of the buttocks support 16.

Figure 11:
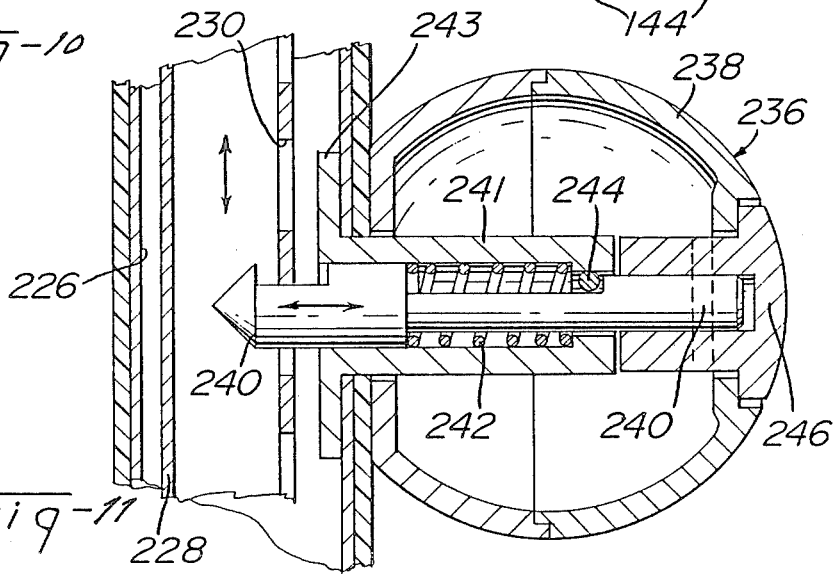
FIG. 11 is a vertical cross-section taken through a detail similar to that shown in FIG. 5, of another different embodiment thereof.

FIG. 11 illustrates another embodiment of the locking pin 36. The embodiment in FIG. 11 has reference numerals raised by 200 which correspond with the numerals in FIG. 5. The carriage 228 in this embodiment is made in the form of a U-shaped channel with apertures 230 provided on one side thereof. The carriage 228 slides in the track 226. The locking pin 236 includes an L-shaped pin 240 moving in a sleeve 241 against the spring 242. A pin 244 acts as a forward limit for the pin 240. The ball or knob 238 is retained on the pin 240 by means of a ball retainer nut 246 fixed to the pin 240. The sleeve 241 includes flanges 243 on the interior of the track 226, as illustrated. The operation of the locking pin 236 is the same as the locking pin 36.

We claim:

1. A seat having a base, a stem having upper and lower ends, the lower end of said stem being pivotally mounted on the base and tiltable relative to the base only about a transverse pivot axis at the base, a buttocks support mounted in a cantilever manner on the front of the stem such that the upper end of the stem projects above the buttocks support, the stem extending rearwardly over the base and adapted to pivot in an arc of movement, means for limiting the pivot arc of movement in a vertical plane normal to the transverse axis between a rest position with the stem at an acute angle behind a vertical plane taken through the transverse pivot axis, a center of the buttocks support being substantially near said vertical plane and a forward position when the stem is adjacent but behind the vertical plane and the center of the buttocks support is forward of the vertical plane.

2. A seat as defined in claim 1, wherein the buttocks support is pivotally mounted on a bracket mounted to the stem, and means are provided for limiting the pivoting movement of the buttocks support about an axis parallel to the transverse pivot axis of the stem to the base in an arc limited between a first and second position.

3. A seat as defined in claim 2, wherein the buttocks support is adjustable in height relative to the stem, by means of a track provided on the stem and sliding track follower means provided on the bracket of the buttocks support, and locking means being provided for locking the track follower at a selected height of the buttocks support on the stem.

4. A seat as defined in claim 2, wherein the buttocks support has a limited pivoting arc within the range of 45°.

5. A seat as defined in claim 1, wherein the arc of movement of the stem between the rest position and the forward position is within 20°.

6. A seat as defined in claim 5, wherein the arc of movement of the stem is between 21° and 9° from the vertical plane.

7. A seat as defined in claim 1, wherein said base includes a first member having a peripheral floor engaging edge, cantilevered resilient members mounting floor engagement wheels, the resilient cantilevered members being such that when there is no load on the buttocks support of the seat, the wheels are in contact with the floor and the floor engaging edge is spaced from the floor allowing the seat to be moved on said wheels, and when a load is borne by the buttocks support, the additional weight overcomes the resilient cantilevered members such that the peripheral edge of the base is in contact with the floor to thereby arrest the seat in a given position.

8. The structure as claimed in claim 7 wherein the wheels are in the form of roller balls mounted in a socket at the end of the cantilered members.

9. The structure as claimed in claim 7, wherein the base includes a sub-frame which is circular and the peripheral edge thereof has a circular locus; the resilient cantilevered members extending radially from an inner portion of the sub-frame and extending outwardly towards the edge, said cantilevered members being regularly spaced so that the seat is completely supported by the wheels when the buttocks support is free of any additional load such that the seat can be moved on the floor, freely in any direction.

* * * * *